US009039324B2

(12) United States Patent
Ackermann et al.

(10) Patent No.: US 9,039,324 B2
(45) Date of Patent: May 26, 2015

(54) COMPACTION DEVICE AND METHOD FOR COMPACTING GROUND

(75) Inventors: Hans-Peter Ackermann, Tirschenreuth (DE); Peter Janner, Krummennaab (DE)

(73) Assignee: HAMM AG, Tirschenreuth (DE)

( * ) Notice: Subject to any disclaimer, the term of this patent is extended or adjusted under 35 U.S.C. 154(b) by 0 days.

(21) Appl. No.: 13/512,371

(22) PCT Filed: Nov. 29, 2010

(86) PCT No.: PCT/EP2010/068418
§ 371 (c)(1), (2), (4) Date: Aug. 10, 2012

(87) PCT Pub. No.: WO2011/064367
PCT Pub. Date: Jun. 3, 2011

(65) Prior Publication Data

US 2012/0301221 A1 Nov. 29, 2012

(30) Foreign Application Priority Data

Nov. 27, 2009 (DE) ..... 10 2009 055 950
Apr. 21, 2010 (DE) ..... 20 2010 005 962 U

(51) Int. Cl.
*E01C 19/28* (2006.01)
*E02D 3/074* (2006.01)

(52) U.S. Cl.
CPC ..... *E01C 19/286* (2013.01); *E01C 19/282* (2013.01); *E02D 3/074* (2013.01)

(58) Field of Classification Search
USPC ..... 404/117, 122, 128, 130; 74/61, 87
IPC ..... E01C 19/286
See application file for complete search history.

(56) References Cited

U.S. PATENT DOCUMENTS

| | | | | |
|---|---|---|---|---|
| 4,285,405 | A * | 8/1981 | Weir, Jr. | 173/162.1 |
| 4,647,247 | A * | 3/1987 | Sandstrom | 404/75 |
| 5,248,216 | A * | 9/1993 | Vural | 404/75 |
| 5,788,408 | A * | 8/1998 | Mitsui et al. | 404/117 |
| 5,797,699 | A * | 8/1998 | Blancke et al. | 404/117 |
| 6,402,424 | B2 * | 6/2002 | Mitsui | 404/117 |
| 6,829,986 | B2 * | 12/2004 | Richter | 100/155 R |

(Continued)

FOREIGN PATENT DOCUMENTS

| | | | |
|---|---|---|---|
| FR | 2748500 | A1 | 11/1997 |
| JP | 1-290801 | * | 11/1989 |

(Continued)

OTHER PUBLICATIONS

International Search Report dated May 3, 2012 from corresponding International Patent Application No. PCT/EP2010/068418-2 pages.

(Continued)

*Primary Examiner* — Gary Hartmann
(74) *Attorney, Agent, or Firm* — Maier & Maier, PLLC

(57) ABSTRACT

A compaction device includes at least one traveling drum rotatable about a drum shaft and having vibration exciters including unbalanced masses rotating out of phase by 180 degrees in the same direction of rotation and generating an oscillation torque about the drum shaft, and having a drive shaft running coaxial to the drum shaft for driving the vibration exciters. The drum is divided at least once and each drum part includes at least two coupled vibration exciters mounted at a distance from the drum shaft in the drum.

19 Claims, 8 Drawing Sheets

(56) References Cited

U.S. PATENT DOCUMENTS

| | | | | |
|---|---|---|---|---|
| 6,857,816 | B2 * | 2/2005 | Saito et al. | 404/128 |
| 7,213,479 | B2 * | 5/2007 | Mitsui | 74/87 |
| 2011/0158745 | A1 * | 6/2011 | Oetken et al. | 404/72 |

FOREIGN PATENT DOCUMENTS

| | | | |
|---|---|---|---|
| JP | 04-134513 | A | 12/1992 |
| JP | 10131977 | A2 | 5/1998 |
| WO | 82/01903 | A1 | 6/1982 |
| WO | 02/44475 | A1 | 6/2002 |

OTHER PUBLICATIONS

Office Action issued in corresponding Japanese patent application No. P2012-540456 mailed Sep. 3, 2013.

* cited by examiner

COMPACTION DEVICE AND METHOD FOR COMPACTING GROUND

RELATED APPLICATIONS

This is the U.S. national stage application which claims priority under 35 U.S.C. §371 to International Patent Application No.: PCT/EP2010/068418, filed on Nov. 29, 2010, which claims priority to German Patent Application No(s) 10-2009-055950.7, filed Nov. 27, 2009 and 20-2010-005962.3, filed Apr. 21, 2010, the disclosures of which are incorporated by reference herein their entireties.

FIELD OF THE INVENTION

The invention relates to a compaction device for the compacting of ground and a method for the compacting of ground.

BACKGROUND

Compaction devices are known e.g. in the form of a road roller.

With the aid of a road roller, ground areas, e.g. asphalt surfaces, can be compacted across large surface areas. In order to guarantee the load-bearing capacity and durability of the ground, sufficient compaction is required. In the compaction performed by road rollers, a distinction is made between a dynamic and a static functionality. In case of a dynamic functionality, the compaction is effected by movement, and in case of a static functionality, the compaction is effected by the weight of the road roller.

A road roller can be a self-propelled vehicle and comprises at least one drum.

When negotiating curves with the drum of a compaction device in the form of a road roller, there exist an inner and an outer curve radius of the drum at the lateral ends of the drum. At the outer-curve edge of the drum, due to the longer distance that is being covered there, the speed is higher than at the inner edge. With increased steering angle and a resultant smaller curve radius, the distance between said two speeds will become larger. Since, however, a drum cannot rotate with different peripheral speeds on its lateral ends, the drum will in the middle of its width be rolling on the underlying ground or soil, whereas, on the outer edge regions of the drum, sliding movements (slippage) will occur between the asphalt and the rolling surface of the drum. For this reason, it appears useful to divide the drum and to drive both halves independently from each other so that, due to the smaller width of the divided drum, the above compulsory effect can be reduced.

Oscillation drums, in contrast to vibration drums, are not produced in a divided configuration because the technical realization is distinctly more difficult. The synchronization of the unbalanced masses generating the centrifugal forces must be guaranteed at all times, particularly also in case of a turning of the drums relative to each other.

In a known oscillating roller according to WO 82/01903, two synchronously rotating imbalance shafts are provided which are driven via a central shaft by means of toothed belts. Thereby, a rapidly changing forward/rearward rotating movement is imposed on the roller. As a result, the rotating roller will never be lifted from the underlying ground.

From WO 82/01903 (FIG. 5), there can be gathered four typical operational state of the oscillation system of an undivided oscillation drum of the state of the art. From left to right, the positions of the unbalanced masses are shown as rotated in respective steps of 90° (phase-shifted).

Because of the coupled drive, the two unbalanced masses (imbalance weights) will rotate in the same sense. While, in the operational states in the left-hand views in FIG. 5, the centrifugal forces will eliminate each other, the rotational moment in the views on the right-hand side (FIGS. 5B, 5D), due to the directions of the centrifugal forces F and the lever arms x, will be $$M=2\cdot x\cdot F$$

in the clockwise (FIG. 5B) and respectively the anticlockwise direction (FIG. 5D).

Thus, with each revolution of the imbalanced shaft, the drum will undergo a slight turn to the left and to the right and will start to oscillate about the rotational axis M of the drum.

In vibration drums, dividing the drum is already known because its technical realization is easy. FIG. 2 of the present description shows a sectional view of a divided vibration drum. The two drum parts 2*a*,2*b* are screwed to each other via a rotary connection. Here, the unbalanced masses 3 for both drum parts 2*a*,2*b* are arranged on the central imbalanced shaft 31 which is driven by a hydraulic engine 7. When a curve is negotiated and the drum parts 2*a*,2*b* are thus turned relative to each other, nothing will change about the vibration of the two drum parts 2*a*,2*b* relative to each other, i.e. both drum parts 2*a*,2*b* will vibrate in synchronism.

A simple configuration with a continuous central shaft 33 for driving the unbalanced masses 3 as in a vibration drum, is shown in FIG. 3 for an oscillation drum. This approach cannot solve the phase problem for the following reasons:

When the drum parts 2*a*,2*b* (roller surfaces) are being turned relative to each other, e.g. while a curve is being negotiated, the position of the unbalanced shafts 31*a*,31*b* relative to each other will change because the imbalance shafts 31*a*,31*b* are supported in the respective drum parts 2*a*,2*b*. Since the unbalanced masses 3, which are driven by toothed belts 32 by a central shaft 33, will maintain their orientation, the direction of the effectiveness of the force in the turned drum part 2*a*,2*b* will each time be shifted (FIG. 4 to FIG. 7).

For better representation of the arrangement of the toothed belts of FIG. 4 to FIG. 7, the described arrangement of the toothed belts is shown in perspective view in FIG. 3.

FIG. 4 and FIG. 5 show the two drum parts 2*a*,2*b* prior to being turned. In FIG. 6 and FIG. 7, the drum parts 2*a*,2*b* are shown after drum part 2*b* has been turned by 90°.

For explanation, it be assumed that the drum part 2*a* does not change its position while the drum part 2*b* continues being turned by 90°. For visualization, also the central rotating shaft is shown in a snapshot and thus is virtually at a standstill. As depicted in FIG. 7, the two unbalanced masses of the right-hand drum part 2*b* have now been positioned above each other. Since the drive shaft 33 in the center of the drum is at a standstill, the toothed belt 32 during the rotation of drum part 2*b* has been rolling on the central drive pulley 21 and did not change the orientation of the unbalanced masses 3. However, due to the new positions of the unbalanced masses 3, the centrifugal forces will now initiate, with maximum leverage, a moment which will cause the drum part 2*b* to rotate. In the position in FIG. 6, on the other hand, no moment is generated since the effective leverage is zero.

The described problematics has the consequence that the drum parts 2*a*,2*b* cannot oscillate in synchronism. In the extreme case, when the two drum parts 2*a*,2*b* operate exactly contrarily to each other, thrust movements will occur in the gap between the drum parts 2*a*,2*b* and in the adjacent regions, so that the asphalt surface will be torn open. Depending on the turning of the drum parts 2*a*,2*b* relative to each other, phase errors from 0 to 180° may occur. Already phase errors from 10 to 20° would shear off the asphalt at the joint between the drum parts 2*a*,2*b*.

Thus, it is an object of the invention to provide a vibration device and respectively method for the compacting of ground which is free of the above described problems.

SUMMARY OF THE INVENTION

According to the invention, it is provided, in a compaction device comprising at least one traveling drum rotatable about a drum shaft, coupled vibration exciters for generating an oscillation torque about the drum shaft, said vibration exciters having unbalanced masses rotating out of phase by 180 degrees in the same direction of rotation, and having a drive shaft running coaxial to the drum shaft for driving the vibration exciters, that the drum is divided at least once and that each drum part comprises at least two coupled vibration exciters mounted in the drum at a distance from the drum shaft.

In this arrangement, the respective vibration exciters are supported in the respective drum parts.

Preferably, it is provided that the drive shafts for the vibration exciters of the individual drum parts are mechanically coupled or via a control means are adjusted to be in-phase so that the vibration exciters of all drum parts will oscillate in synchronism also in case of a turning of the drum parts relative to each other.

The controlling can be performed electrically, electronically or hydraulically/pneumatically.

The drive shafts for the vibration exciters of the adjacent drum parts can be mechanically coupled via a transmission, said transmission being operative to transmit the rotation and respectively the drive torque of a drive shaft with correct phase to the following drive shaft of the drum part.

The transmission for coupling the drive shaft parts can be a planetary gear transmission or a spur gear transmission or a bevel gear transmission.

The drum is of a two-part design, and each drum part comprises a traveling drive of its own, the two drum parts being connected to each other in a manner allowing them to be turned coaxially relative to each other.

A planetary gear transmission, preferably being of the insertable type, can comprise at least two planetary gear sets.

Said planetary gear transmission made of two planetary gear sets can comprise a common planet carrier, with ring gears of the planetary gear sets being respectively connected to a drum part for common rotation therewith, and the respective drive shaft parts being connected to the respective sun gears of the planetary gear sets.

The drive for driving the unbalanced masses can be a belt transmission or a chain transmission.

The drive for driving the vibration exciters preferably is a toothed-belt transmission with omega loop, said toothed-belt transmission driving toothed-belt pulleys coupled with unbalanced masses.

The drive preferably is a belt transmission with a belt guiding arrangement allowing for reversal of the direction of circulation and for a reciprocal transmission ratio toward the planetary gear transmission.

The transmission ratio of the belt transmission and the transmission ratio of the planetary gear transmission shall together result in a transmission ratio of 1:1.

There can also be provided a multi-stage planetary gear transmission and a belt transmission without reversal of rotational direction and without reciprocal transmission ratio toward the planetary gear transmission.

The vibration exciters comprise unbalanced masses and said unbalanced masses preferably comprise unbalanced plates being preferably laterally fastened to the pulleys of the toothed-belt transmission and having a radially outward flank which in a predetermined starting position is in alignment with the belt of the belt transmission if the rotational angle displacement between the two imbalance shafts and respective pulleys corresponds to the desired value. Preferably, the belt transmission is a toothed-belt transmission.

A belt tensioning device can tension the belt for driving the unbalanced masses and respectively of the pulleys with the aid of an eccentrically displaceable bearing pin for the pulley.

Said belt tensioning device can comprise an eccentric adjustment pin for turning and arresting said eccentric bearing pin.

The belt transmission can comprise pulleys which are coaxial and concentric with the rotational axis of the unbalanced masses and whose weight distribution does not extend with rotational symmetry with respect to the rotational axis of the unbalanced masses.

Recesses in the material of the toothed-belt pulley, being not symmetrical with the rotational axis of the unbalanced masses, preferably in the form of holes or bores, can effect a non-rotationally symmetric weight distribution and can form a negative unbalanced mass.

Laterally arranged unbalanced plates can be fastened to the pulleys, and/or asymmetrically arranged screws can form an imbalance weight, said screws being also adapted for attachment of the unbalanced plates.

For accommodating the rolling bearings of the unbalanced masses, cantilevered pivot pins can be provided, said bearings preferably being arranged centrically to the radial belt force and centrifugal force of the unbalanced masses.

For tensioning the belt, these bearing pins are displaceably supported in the circles of the drum parts.

For the compacting of ground by means of a drum of a compacting device, it is provided that, with the aid of at least one vibration exciter comprising rotating imbalance weights, compacting vibrations of the drum are generated, wherein, by the use of a divided drum with two drum halves, in which the imbalance weights of the vibration exciters in each part of the drum are rotated by the same angle with respect to the phase position as in the turning of the drum halves relative to each other, in order to obtain a synchronization of the oscillatory movement of the two drum halves even if the drum halves have been turned relative to each other.

A mechanical connection is provided to allow for synchronization of the exciter forces in both drum halves. This function is fulfilled by a multi-stage planetary gear transmission.

In this arrangement, a gear transmission has the function to transmit, with correct phase, the moment of the hydraulic motor provided for driving the unbalanced masses, from the left drum to the right drum.

BRIEF DESCRIPTION OF THE DRAWINGS

Embodiments of the invention will be explained in greater detail hereunder with reference to the drawings.

The following is shown.

DETAILED DESCRIPTION OF THE DRAWINGS

Figure 1:
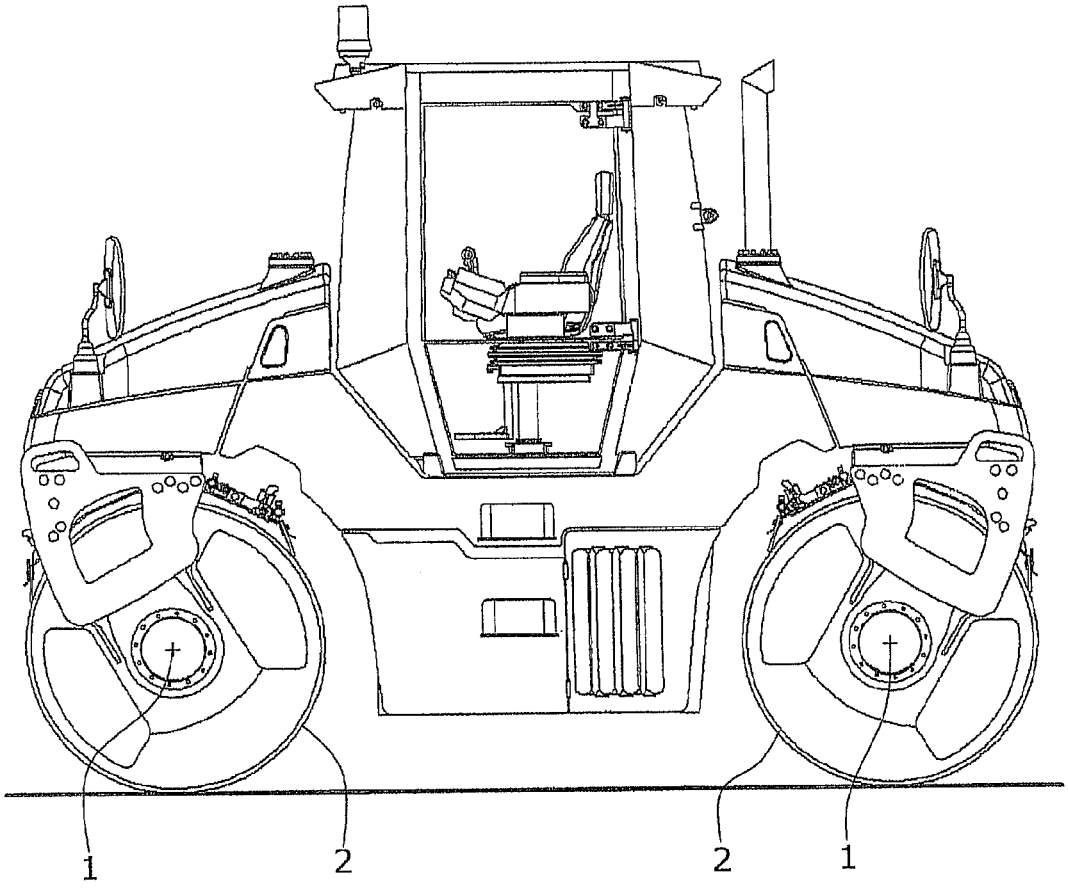
FIG. 1 a vibration device.
Figure 2:
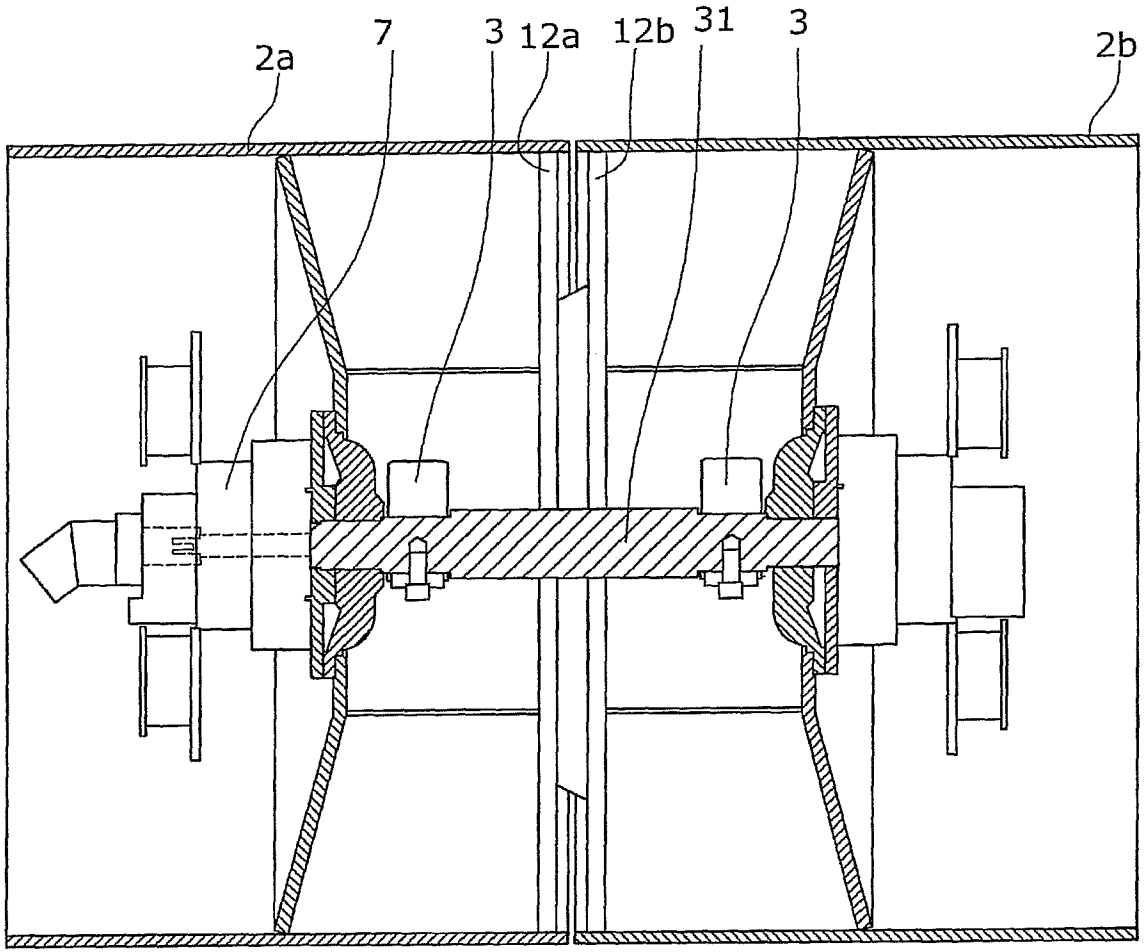
FIG. 2 a divided vibration drum of the roller DV90 according to the state of the art, FIG. 3 a simple toothed belt guiding arrangement for divided oscillation by which the phase problem cannot be solved, FIGS. 4 to 7 different drum positions, FIG. 8 a sectional view of the drum according to the invention, FIG. 9 a planetary gear set, FIG. 10 a toothed-belt transmission with omega loop, FIG. 11 the eccentricity of the imbalance flange/bearing pin, and FIG. 12 a perspective view of a toothed-belt pulley.
Figure 3:
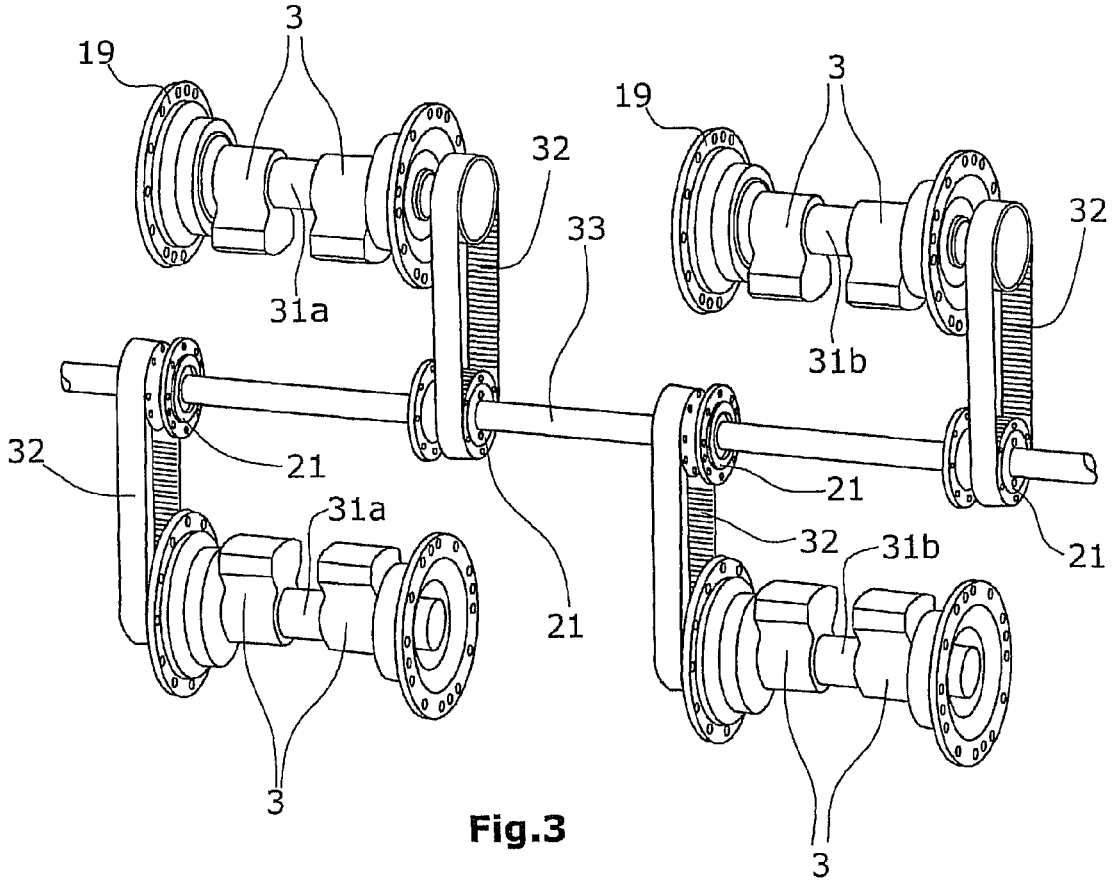
Figure 4:
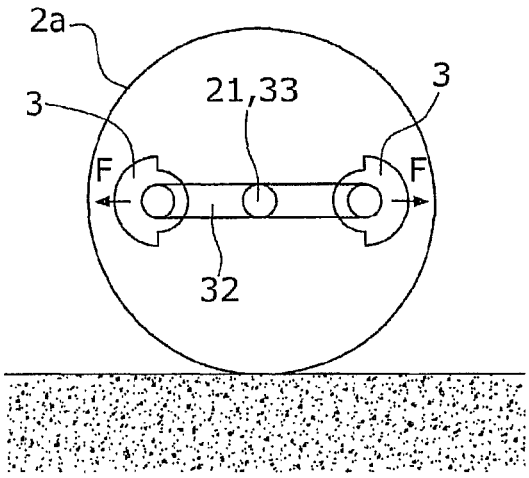
Figure 5:
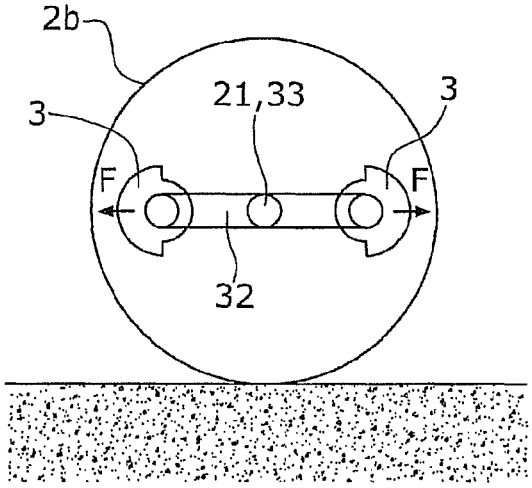
Figure 6:
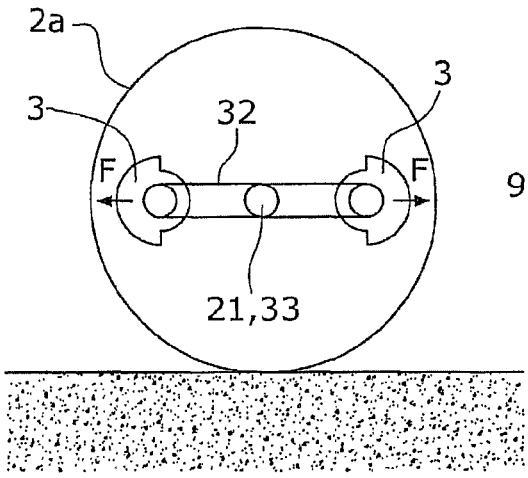
Figure 7:
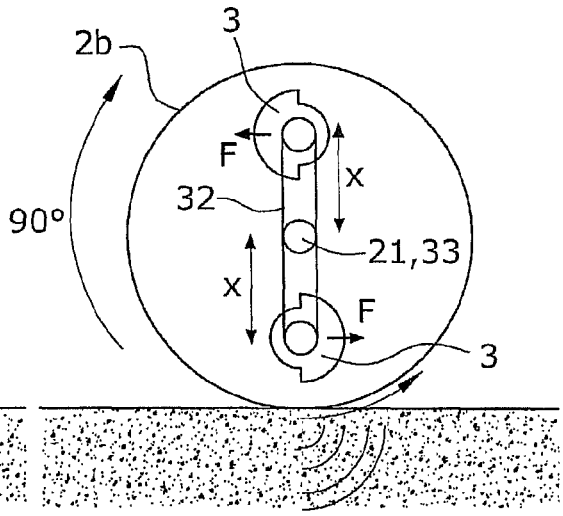

FIG. 1 illustrates, as an example of a vibration device, a road roller engine, namely particularly a tandem-type vibration roller engine comprising a front and a rear drum 2.

FIGS. 2 to 7, as already mentioned in the introduction to the specification, illustrate the state of the art.

Figure 8:
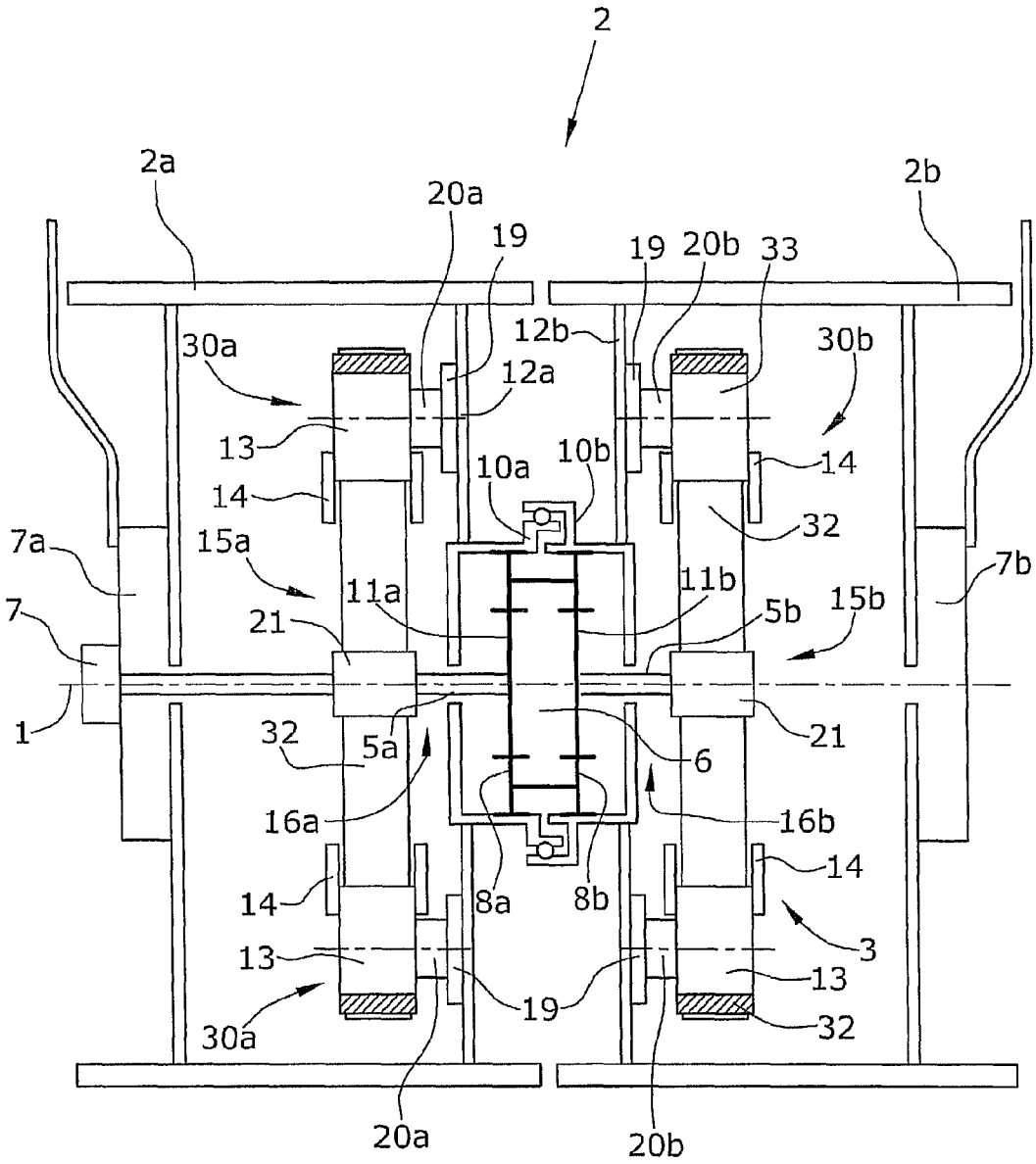

In FIG. 8, a divided oscillatable drum 2 is shown. There are illustrated the two drum parts 2*a*,2*b* with in-built gear transmission, e.g. the planetary gear transmission 6 shown in FIG. 9 for solving the phase problem when negotiating curves, unbalanced masses (imbalance weights) 3 of the vibration exciters 30*a*,30*b*, and attachments.

Travel drives 7*a*,7*b* are provided to drive the respective drum parts 2*a*,2*b*. The planetary gear transmission 6 comprises two planetary gear sets 6*a*,6*b*.

Each drum part 2*a*,2*b* comprises an inner end-side ring 12*a*,12*b* in which e.g. bearing pins 20*a*,20*b* are supported for accommodating rotatable unbalanced masses 3 of the vibration exciters 30*a*,30*b*.

Via the bearing pin 16*a* and the round wall 12*a*, the ring gear 10*a* on the left-hand side of the first planetary gear set 6*a* is tightly connected to the drum part 2*a* on the left-hand side of drum 2. Via the bearing pin 16*b* and the ring 12*b*, the ring gear 10*b* on the right-hand side of the drum is connected to the drum part 2*b* on the right-hand side of drum 2.

Figure 9:
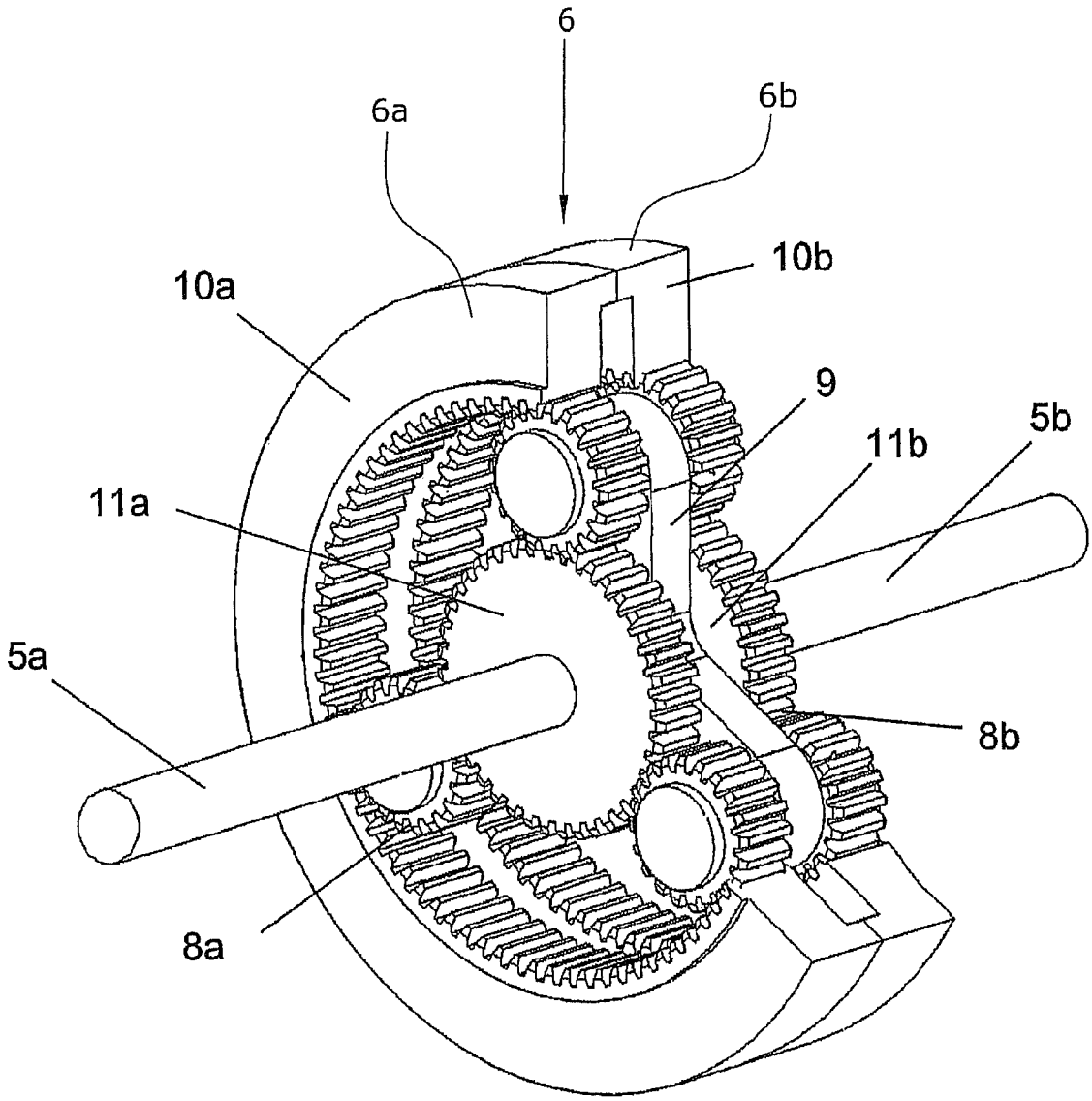

In FIG. 9, the configuration of a planetary gear transmission 6 is shown.

The synchronization of the imbalance moments is independent from the turning of the drum parts 2*a*,2*b*. For ease of explanation, the following be assumed:

The hydraulic motor 7 for driving the oscillation movement is running, and the drum parts 2*a*,2*b* are not in motion, i.e. both drum parts 2*a*,2*b* are at a standstill. As a consequence, both ring gears 10*a*,10*b* shown in FIG. 9 are blocked because, as already described, they are connected to the drums 2*a*,2*b* in a manner fixing them against turning.

In the planetary gear set 6*a* on the left-hand side in FIG. 9, the drive moment which is transmitted by the hydraulic motor 7 onto the drive shaft 5*a* (sun shaft), is passed on to the planet carrier 9 via the sun gear 11*a* and the planetary gears 8*a*. What holds true here is case 3 (sun gear driving, web outputting) of the elementary planet gear set according to table 2. The transmission ratio i will thus be 3.

The numbers of the teeth of the wheels of the planetary gear set 6 for calculation of the transmission ratios are listed in Table 1.

TABLE 1

| Numbers of the teeth of the transmission gears | | | |
|---|---|---|---|
| | Wheel | | |
| | 1 sun gear | 2 planetary gear | 3 ring gear |
| Number of teeth | 40 | 20 | 80 |

From planet carrier 9, the moment will now be further transmitted, via the planetary gears 8*b* of the right-hand stage, to the right-hand sun gear 11*b* and the drive shaft (sun shaft) 5*b* (FIG. 9). Since the two planetary gear sets 6*a*,6*b* are identical in configuration, the transmission ratio i according to Table 2, case 4, will thus be ⅓ for the right-hand stage (planetary gear set 6*b*). In the moment transmission, this will result in a total transmission ratio of 1 (left-hand sun gear 11*a* to right-hand sun gear 11*b*).

Therefore, if both drum parts 2*a*,2*b* are rotating with the same rotational speed—during travel along a linear path or during standstill—i.e. when no turning of the drum parts 2*a*,2*b* relative to each other occurs, the moment of rotation will be transmitted as desired with a transmission ratio 1:1 from one side to the other.

TABLE 2

| Case | Fixed to casing | Input drive | Output | Transmission ratio i |
|---|---|---|---|---|
| 2 | web | ring gear | sun | $-z1/z3 = -1/2$ |
| 3 | ring gear | sun | web | $(z1 + z3)/z1 = 3$ |
| 4 | ring gear | web | sun | $Z1/(z1 + z3) = 1/3$ |

In the turning of one drum part 2*a* relative to the other, 2*b*, it must be guaranteed that the unbalanced masses 3 will be rotated along in the same extent.

For ease of explanation, the following be assumed:

The drum part 2*a* on one side is at a standstill, the hydraulic motor 7 is not running. This means, put briefly, that the ring wheel 10*a* of the first stage (planetary gear set 6*a*) which is connected to drum part 2*a*, and the sun gear 11*a* of the first planetary gear set 6*a* which via drive shaft 5*a* is coupled to the hydraulic motor 7, are at a standstill. As a result, the planetary gear set 6*a* on one side (the left side in FIG. 9) is blocked.

The drum part 2*b* on the other side is now imagined to be rotated by a random angle.

The ring gear 10*b* of the planetary gear set 6*b* on the other side (the right-hand side in FIG. 9) is connected, via the ring gear driver and the bearing pin 16*b*, to the drum part 2*b*. The latter will now transmit the rotation of drum part 2*b* via the planetary gears 8*b* to the sun gear 11*b* on the right-hand side. The common planet carrier 9, as already explained, is blocked via the planetary gear set on the left-hand side. Thus, there holds true case 2 of the elementary planetary gear set of Table 2. The transmission ratio i will thus be −0.5.

As already explained, the unbalanced mass 3 has to be rotated by the same angle as the drum part 2*a*,2*b* in which it is supported, in order to achieve a synchronization of the oscillation movement in both drum parts 2*a*,2*b*.

Preferably, as a planetary gear set 6, use can be made of a two-stage planetary gear transmission comprising a belt transmission with reversal of the rotational direction and with reciprocal transmission ratio.

The respective ring gears 10*a*,10*b* of the planetary gear sets 6*a*,6*b* are connected to the drum parts 2*a*,2*b* for common rotation therewith by way of bearing pins 16*a*,16*b* arranged in the adjacent round walls 12*a*,12*b* of the drum parts 2*a*,2*b*, wherein the bearing pins 16*a*,16*b* also form the support of the central drive pulleys 21 of the toothed-belt transmission 15*a*, 15*b* for driving the vibration exciters 30*a*,30*b*.

Alternatively, there can also be used a multi-stage planetary gear transmission with a belt transmission ratio unequal to the reverse value of the gear transmission and without a reversal of directions.

Figure 10:
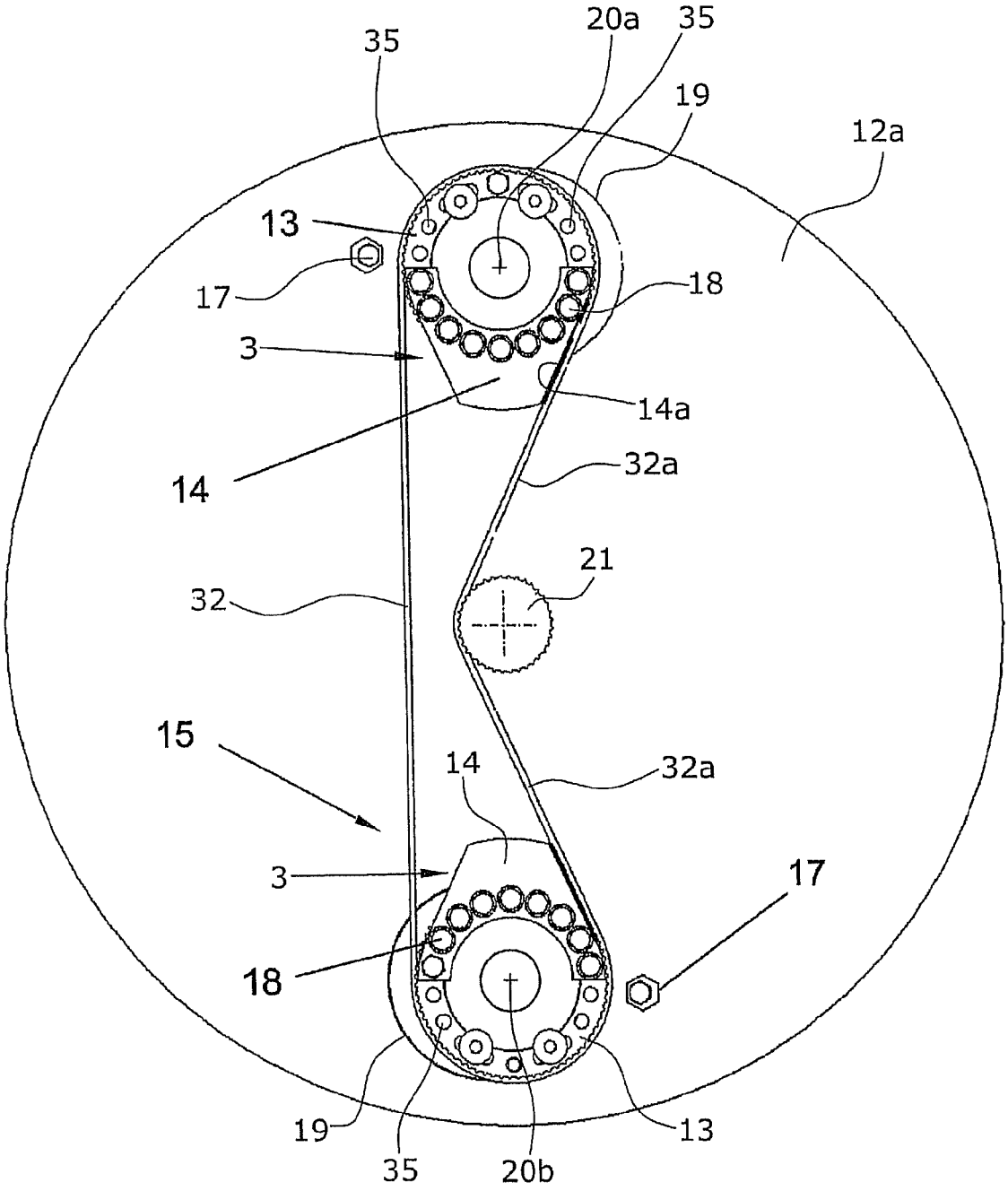

Due to the guidance of the toothed belt 32*c* with omega loop (see FIG. 10) and a transmission ratio of −2, there is no need for a third planetary gear stage which would achieve a total transmission ratio 1 and a reversal of directions. The omega loop is to say that the toothed belt 15*c* encloses the toothed-belt pulleys 13 by more than 180°, e.g. by more than about 200° to 210°, particularly 205°, as shown in FIG. 10.

Also here, due to the individual transmission ratios of −0.5 in the planetary gear set, and −2 in the toothed-belt transmission 15, the total transmission ratio will be 1.

Thus, the unbalanced masses 3 will be adjusted by the same angle as the turned drum parts 2*a*,2*b*, as required. The moments generated by the oscillation imbalances will thus be in the same phase in each drum part 2*a*,2*b*, irrespective of the current orientation of the unbalanced masses 3 relative to each other.

In the guiding arrangement of the toothed belts, there have been realized some basic innovations and advantageous changes.

A belt will drive one or a plurality of imbalance shafts. If the drive according to WO 82/201903 were applied to a divided drum 20, there would be required eight pulleys and four belts.

Here, in contrast to the previous non-divided constructions (WO 82/201903) where each imbalance shaft is provided with its own toothed-belt drive, both unbalanced masses 3 of a drum part 2*a*,2*b* will be driven by one belt, preferably a toothed belt 32. Thereby, respectively one toothed belt 32 and one drive pulley can be omitted per drum half.

In the toothed-belt guiding arrangement, there is realized, as already described, a transmission ratio of −2. This has been achieved with the aid of the omega loop of the toothed belt 32 according to FIG. 10. For this purpose, the large pulleys 13 comprise twice the number of teeth as the smaller drive pulley 21.

By the deflection at the smaller drive pulley 21, the direction of rotation is changed, which leads to the required negative transmission ratio.

By the required transmission ratio of the toothed-belt transmission of −2, it should preferably be possible to use a large toothed-belt pulley 13 within which also large part of the unbalanced mass 3 can be realized.

Since it is required anyway to drill holes into the toothed-belt pulley 13 for screw attachment of the imbalance plates 14, additional bores 35 can be applied in order to establish a part of the required imbalance 3 on the opposite side of the imbalance weights in the form of unbalanced plates 14 (negative imbalance). A further advantage resides in the smaller moment of inertia of toothed-belt pulley 13 achieved by the reduced weight, allowing for faster run-up when starting the drive.

The remaining portion of the unbalanced mass 3 is realized by the lateral imbalance plates 14 and e.g. the nine screws 18 forming an imbalance weight (positive imbalance), by which the imbalance plates 14 are—preferably on both sides—fastened to the toothed-belt pulleys 13 (FIG. 10).

Thus, the toothed-belt pulley 13, being necessary anyway, also serves as an unbalanced mass 3. The imbalance plates 14 arranged laterally of the toothed-belt pulley 13 are screwed directly to the respective toothed-belt pulleys 13. The screws 18 form an additional imbalance weight. In this arrangement, the holes or bores 35 on the side opposite to the screws 18 form a negative imbalance.

In FIG. 10, the two laterally fastened imbalance plates 14 are shown in the mounting position with installed toothed belt 32. The outer contour of the imbalance plates 14 is provided to the effect that the oblique flank 14*a* on the sides of the imbalance plates 14 is in exact alignment with the short strand 32*a* of the toothed belt 32. This is one possibility for visually checking the correct 180° displacement of the unbalanced masses 3 by way of the orientation of the toothed belt 32.

The angles of the oblique flanks 14*a* of the imbalance plates 14 correspond to the angle of the belt 32 on the omega-enclosed side in the position shown in FIG. 10.

The imbalance plates 14 are preferably arranged on both sides of the toothed-belt pulley in the same position. By way of the thickness of the imbalance plates 14, the mass of the imbalance 3 can be varied, which can also be effected via the number of the screws 18 or the size of the bores 35.

Previously, the required belt tension of the toothed belt 32 was generated either with the aid of an additional tensioning roller or by exclusive use of selected, well-dimensioned toothed belts 32 having a length exactly corresponding to the tolerances.

Figure 11:
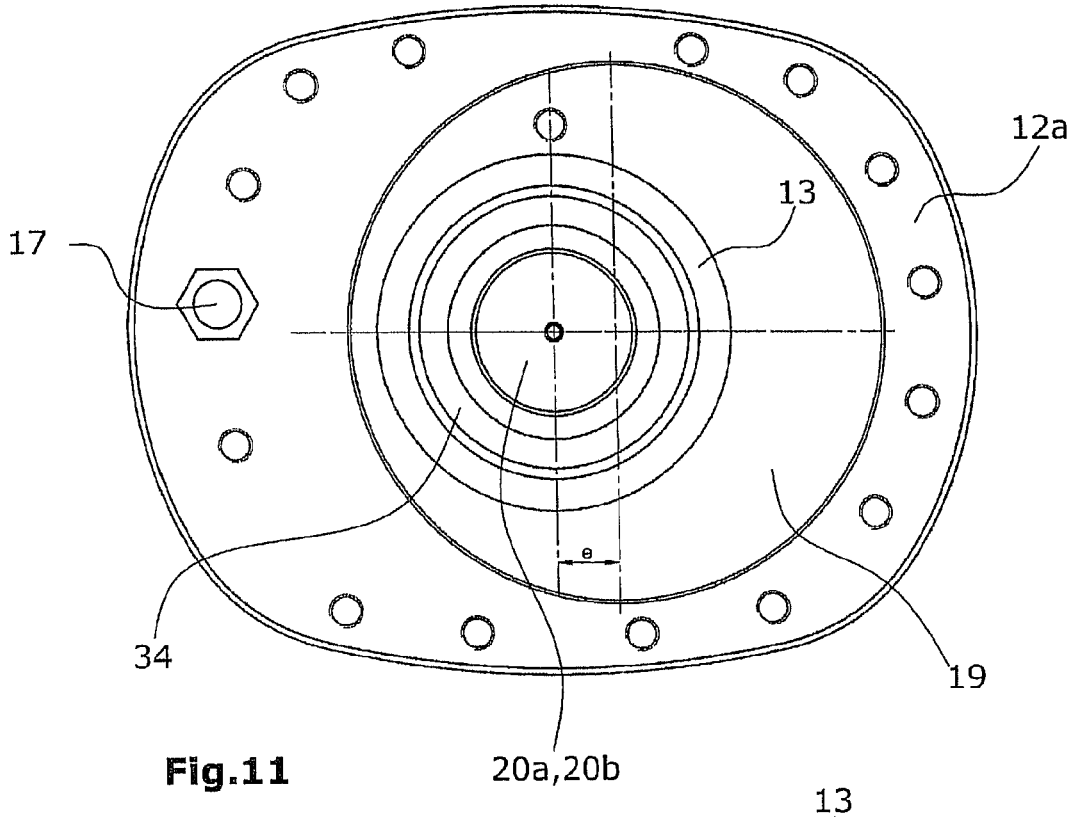

In the present construction shown in FIGS. 10 and 11, the belt tension is set by continually changing the distance of the axes between the drive shaft 5*a*,5*b* and the axis of the bearing pin 20*a*,20*b*. This is achieved by turning the eccentrically supported bearing pin 20*a*,20*b* at the imbalance flange 19 (FIG. 11).

The turning of the eccentric imbalance flange 19 by the bearing pin 20*a*,20*b* for tensioning the toothed belt 15*c* is performed by turning an eccentric adjustment pin 17 (FIG. 10). The latter comprises two mutually eccentric cylinders and a hexagon for application of a wrench.

The eccentric adjustment pin 17 is provided for turning the eccentric imbalance flange 19.

Due to the eccentricity, turning the adjustment pin 17 will cause the imbalance flange 19 to be turned relative to the round wall 12*a*,12*b*.

Thus, the belt 32 can be tensioned by means of an eccentrically displaceable bearing pin arrangement.

The cantilevered bearing pin 20*a*,20*b* serves for accommodating a rolling bearing 34 for the toothed-belt pulley 13. The rolling bearing 34 is arranged centrically relative to the radial belt force and centrifugal force of the unbalanced masses 3.

Figure 12:
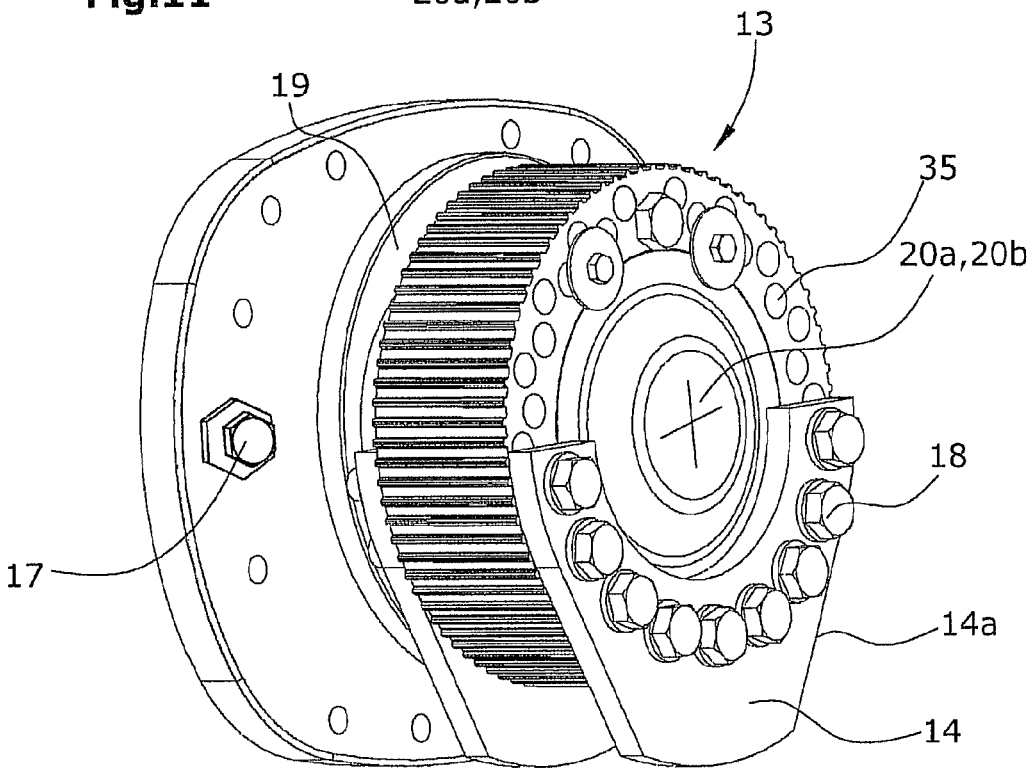

FIG. 12 shows a perspective view of the toothed-belt pulley 13 without toothed belt 32.

The invention claimed is:

1. A compaction device, comprising:

at least one traveling drum rotatable about a drum shaft, coupled vibration exciters generating an oscillation torque about the drum shaft, said vibration exciters having unbalanced masses rotating out of phase by 180 degrees in a same direction of rotation, and having a drive shaft running to the drum shaft for driving the vibration exciters, wherein the drum is divided into at least two drum parts, wherein the at least two drum parts are substantially adjacent one another, and wherein each drum part comprises at least two coupled vibration exciters mounted in the drum at a distance from the drum shaft, wherein the drive shafts for the vibration exciters of each of the at least two drum parts are mechanically coupled directly to each other via a transmission or, via a control means, are adjustable to be in-phase ensuring that the vibration exciters of all drum parts always oscillate in synchronism also in case of a turning of the drum parts relative to each other.

2. The compaction device according to claim 1, wherein said transmission is operative to transmit a rotation and respectively a drive torque of a drive shaft with a correct phase, to a following drive shaft of a drum part.

3. The compaction device according to claim 2, wherein the transmission for coupling the at least two drive shaft parts is one of a planetary gear transmission, a spur gear transmission, and a bevel gear transmission.

4. The compaction device according to claim 1, wherein the drum is of a two-part design and each of the at least two drum parts comprises a traveling drive of its own, the at least two drum parts being connected to each other in a manner allowing them to be turned coaxially relative to each other.

5. The compaction device according to claim 3 wherein the planetary gear transmission comprises at least two planetary gear sets.

6. The compaction device according to claim 5, wherein the planetary gear transmission comprises two planetary gear sets having a common planetary carrier, wherein ring gears of the planetary gear sets are respectively connected to a drum part for common rotation therewith, and respective drive shaft parts are connected to respective sun gears of the planetary gear sets.

7. The compaction device according to claim 6, wherein the drive shaft part of each of the at least two drum parts is operative to drive, via a gear transmission, the at least two vibration exciters.

8. The compaction device according to claim 7, wherein a drive for driving the unbalanced masses is one of a belt transmission and a chain drive.

9. The compaction device according to claim 2, wherein a drive for driving the vibration exciters is a toothed-belt transmission comprising a toothed belt for driving toothed-belt pulleys coupled with unbalanced masses.

10. The compaction device according to claim 8, wherein the drive is a belt transmission with a belt guiding arrangement allowing for reversal of the direction of circulation and for a reciprocal transmission ratio toward the planetary gear transmission.

11. The compaction device according to claim 10, wherein a transmission ratio of the belt transmission and a transmission ratio of the planetary gear transmission together result in a transmission ratio of 1:1.

12. The compaction device according to claim 8, wherein a multi-stage planetary gear transmission and a belt transmission without reversal of rotational direction and without reciprocal transmission ratio toward the planetary gear transmission are provided.

13. The compaction device according to claim 9, wherein the vibration exciters comprise unbalanced masses and said unbalanced masses comprise unbalanced plates being laterally fastened to toothed-belt pulleys of the toothed-belt transmission and having a radially outward flank which in a predetermined starting position is in alignment with the toothed belt of the toothed-belt transmission if a rotational angle displacement between the two toothed-belt pulleys driven by the toothed-belt transmission corresponds to a desired value.

14. The compaction device according to claim 9, wherein a belt tensioning device is operative to tension the belt for driving the unbalanced masses and respectively of the pulleys with the aid of an eccentrically displaceable bearing pin.

15. The compaction device according to claim 14, wherein said belt tensioning device comprises an eccentric adjustment pin for turning said eccentric bearing pin.

16. The compaction device according to claim 8, wherein the belt transmission comprises pulleys which are coaxial and concentric with a rotational axis of the unbalanced masses and whose weight distribution does not extend with rotational symmetry with respect to the rotational axis of the unbalanced masses.

17. The compaction device according to claim 16, wherein recesses in the material of the toothed-belt pulley, being not symmetrical with the rotational axis of the unbalanced masses, effect a non-rotationally symmetric weight distribution and form a negative unbalanced mass.

18. The compaction device according to claim 9, wherein at least one of a plurality of unbalanced plates are fastened to at least one of the pulleys, and asymmetrically arranged screws form an unbalanced mass, said screws to being also adapted for attachment of the unbalanced plates.

19. The compaction device according to claim 1, wherein, for accommodating rolling bearings of the unbalanced masses, cantilevered pivot pins are provided, said rolling bearings being arranged centrically to a radial belt force and a centrifugal force of the unbalanced masses.

* * * * *